US007235926B2

(12) United States Patent
Hwang et al.

(10) Patent No.: US 7,235,926 B2
(45) Date of Patent: Jun. 26, 2007

(54) PLASMA DISPLAY PANEL

(75) Inventors: Eui-Jeong Hwang, Suwon-si (KR); Tae-Ho Lee, Suwon-si (KR)

(73) Assignee: Samsung SDI Co., Ltd., Suwon-si, Gyeonggi-so (KR)

( * ) Notice: Subject to any disclaimer, the term of this patent is extended or adjusted under 35 U.S.C. 154(b) by 0 days.

(21) Appl. No.: 11/153,452

(22) Filed: Jun. 16, 2005

(65) Prior Publication Data

US 2005/0285529 A1 Dec. 29, 2005

(30) Foreign Application Priority Data

Jun. 23, 2004 (KR) ..... 10-2004-0047039

(51) Int. Cl.
*H01J 17/49* (2006.01)

(52) U.S. Cl. ..... 313/585; 313/584; 313/582

(58) Field of Classification Search ..... 313/582–587, 313/498–512

See application file for complete search history.

(56) References Cited

U.S. PATENT DOCUMENTS

| | | | | |
|---|---|---|---|---|
| 5,541,618 | A | 7/1996 | Shinoda | |
| 5,661,500 | A | 8/1997 | Shinoda et al. | |
| 5,663,741 | A | 9/1997 | Kanazawa | |
| 5,674,553 | A | 10/1997 | Sinoda et al. | |
| 5,724,054 | A | 3/1998 | Shinoda | |
| 5,786,794 | A | 7/1998 | Kishi et al. | |
| 5,952,782 | A | 9/1999 | Nanto | |
| 6,157,354 | A * | 12/2000 | Amemiya | 345/60 |
| RE37,444 | E | 11/2001 | Kanazawa | |
| 6,531,819 | B1 * | 3/2003 | Nakahara et al. | 313/584 |
| 6,603,263 | B1 * | 8/2003 | Hashimoto et al. | 313/584 |
| 6,630,916 | B1 | 10/2003 | Shinoda | |
| 6,707,436 | B2 | 3/2004 | Setoguchi et al. | |

FOREIGN PATENT DOCUMENTS

| | | |
|---|---|---|
| JP | 02-148645 | 6/1990 |
| JP | 2845183 | 10/1998 |
| JP | 2917279 | 4/1999 |
| JP | 2001-043804 | 2/2001 |
| JP | 2001-325888 | 11/2001 |

OTHER PUBLICATIONS

"*Final Draft International Standard*", Project No. 47C/61988-1/Ed. 1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing.

* cited by examiner

*Primary Examiner*—Mariceli Santiago
*Assistant Examiner*—Anne M Hines
(74) *Attorney, Agent, or Firm*—Robert E. Bushnell, Esq.

(57) ABSTRACT

A plasma display panel (PDP) with improved bright room contrast while achieving a high opening ratio and high luminance. The PDP includes display electrodes that includes auxiliary electrodes that suppress reflection of incident light off the discharge cells. With address electrodes formed on the rear substrate and the display electrodes formed on the front substrate, auxiliary electrodes connect pairs of display electrodes together. The auxiliary electrodes and the main bus electrodes extend into the discharge cells and reflect the external light. The opaque main bus and auxiliary electrodes are combined with a transparent electrode portion that overlies the main bus and the auxiliary portions to form the display electrodes.

17 Claims, 4 Drawing Sheets

PLASMA DISPLAY PANEL

CLAIM OF PRIORITY

This application makes reference to, incorporates the same herein, and claims all benefits accruing under 35 U.S.C. §119 from an application for PLASMA DISPLAY PANEL earlier filed in the Korean Intellectual Property Office on 23 Jun. 2004 and there duly assigned Serial No. 10-2004-0047039.

BACKGROUND OF THE INVENTION

1. Field of the Invention

The present invention pertains to a plasma display panel (PDP), and in particular, to a design for a PDP design that results in improved bright room contrast while maintaining a high opening ratio and a high luminance.

2. Description of the Related Art

In general, a PDP is a display device where ultraviolet rays generated during gas discharge excite phosphors to produce a visible image. PDPs have received a lot of attention recently as next generation display devices because of their large screen size, thin depth, and high resolution.

PDPs are classified into direct current (DC) types and alternating current (AC) types based on the driving power. One type of AC PDP that has become very popular recently is the three-electrode type AC PDP that has an address electrode and a pair of display electrodes.

PDPs can be further classified according to the layout of the discharge cells where an independent discharge takes place. For example, the PDP can be classified as a stripe-type (or in-line type), where three red (R), green (G), blue (B) discharge cells are arranged in a stripe pattern, or a delta-type where discharge cells have a triangular shape.

In both the stripe-type and delta-type PDPs, address electrode, barrier ribs, and a phosphor layers are formed on the rear substrate and correspond to each discharge cell bounded by the barrier ribs, and display electrodes that include of scan electrodes and sustain electrodes are formed on the front substrate. A dielectric layer is formed on the rear substrate and on the front substrate to cover the display electrodes and the address electrodes. A discharge gas, being a Ne—Xe gas mixture, fills the discharge cells at locations where the address electrodes cross the display electrodes.

A discharge cell for light emission is selected by an address discharge that occurs when an address voltage is applied between the address electrode and the scan electrode. Then, a plasma discharge takes place inside selected discharge cells by applying a sustain voltage between the sustain electrode and the scan electrode, generating a plasma that emits vacuum ultraviolet rays that excites the phosphor layer in the discharge cell to emit visible light to form an image.

In an AC PDP, the sustain electrodes and the scan electrodes are made of a transparent material, such as indium-tin oxide (ITO), so that visible rays can be transmitted through them. The poor conductance of the transparent material is compensated by an additional bus electrode that is made of a highly conductive and opaque metal and is located outside the discharge area.

As described above, a higher opening ratio can be achieved by having the scan and the sustain electrodes made of a transparent material and also by having bus electrodes located outside the discharge area. However, such a design results in poor bright room contrast of the PDP operating under in bright room conditions because of a low absorption efficiency of outside light. Therefore, what is needed is a design for an AC PDP that provides for improved bright room contrast while also having a high opening ratio and high luminance characteristics.

SUMMARY OF THE INVENTION

It is therefore an object of the present invention to provide an improved design for a PDP.

It is also an object of the present invention to provide a design for a PDP that has improved bright room contrast while having a high opening ratio.

It is further an object of the present invention to provide a design for a PDP that is easy to manufacture.

It is still an object of the present invention to provide a design for a PDP that has superior luminance characteristics.

These and other objects can be achieved by a PDP that includes a first substrate, a second substrate arranged facing the first substrate, address electrodes extending in a first direction on the first substrate, barrier ribs located between the first substrate and the second substrate and dividing a space between the first and the second substrates into a plurality of discharge cells, a phosphor layer formed inside the discharge cells, and display electrodes that include a first display electrode and a second display electrode formed at certain locations on the second substrate, the certain locations corresponding to the discharge cells. The first display electrode and the second display electrode include a first main bus electrode and a second main bus electrode, respectively. Each main bus electrode extends in a second direction and crosses the address electrodes at locations corresponding to sides of the discharge cells. The first display electrode and the second display electrode also include a first auxiliary bus electrode and a second auxiliary bus electrode, respectively, each extending in the first direction. Each of the first auxiliary bus electrode and the second auxiliary bus electrode connect a first main bus electrode of one discharge cell to a second main bus electrode of a neighboring discharge cell.

The first display electrode and the second display electrode can include first and second transparent electrodes, respectively, that are both superposed partially on the first and the second main bus electrodes, respectively. Each transparent electrode extends towards the center of corresponding discharge cells and is arranged to face a neighboring transparent electrode. The first and the second main bus electrodes and the first and the second auxiliary bus electrodes are preferably made of a highly conductive and opaque metallic material that supresses the reflection of incident light off the discharge cells.

Furthermore, the first and the second main bus electrodes, and the first and the second auxiliary bus electrodes each form a stripe pattern. The first and the second display electrodes are located, respectively, at a location near second and first display electrodes respectively of the neighboring discharge cells in the first direction. The first and the second main bus electrodes are located near the edges of the discharge cells, and the first and the second auxiliary bus electrodes are located near the center of the discharge cells.

Each of the first and the second auxiliary bus electrodes can be connected to both the first and the second main bus electrodes at the ends of the first and the second auxiliary bus electrodes. Also, both ends of the first and the second auxiliary bus electrodes can extend beyond the first and the second main bus electrodes, respectively, by a small amount, extending towards the center of the discharge cells. Furthermore, both ends of the first and the second auxiliary bus electrodes can also be connected to protrusions at the ends of the auxiliary electrodes, the protrusions extending in the second direction.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings, in which like reference symbols indicate the same or similar components, wherein.

DETAILED DESCRIPTION OF THE INVENTION

Figure 1:
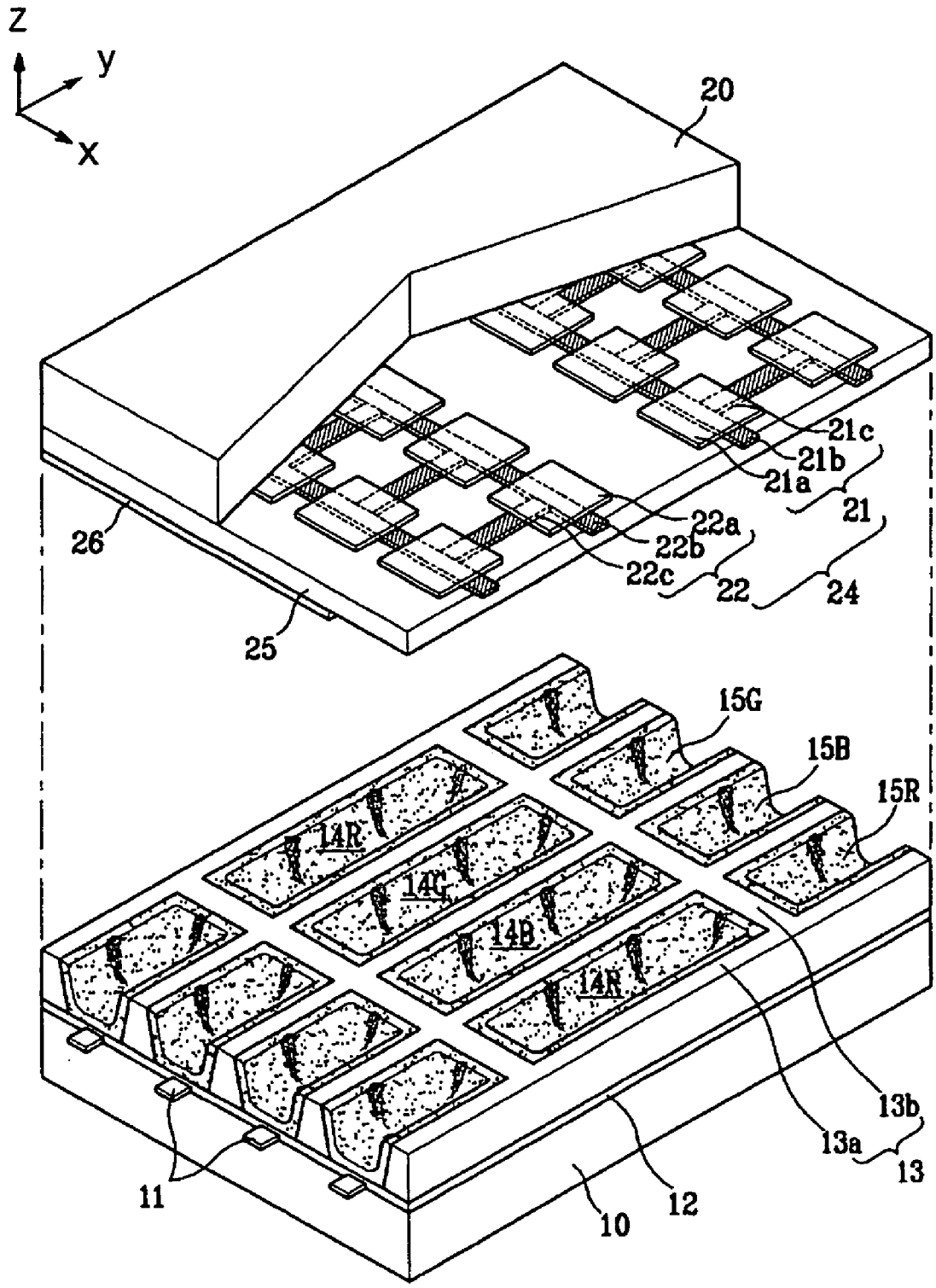
FIG. 1 is a partial perspective view of a disassembled PDP according to a first embodiment of the present invention.

As illustrated in FIG. 1, a PDP according to the present invention includes a first substrate 10, a second substrate 20 facing the first substrate 10 and spaced apart from the first substrate 10 by a certain distance, and discharge cells 14R, 14G, 14B surrounded by barrier ribs 13, the barrier ribs 13 having a height corresponding to the certain distance between the first substrate 10 and the second substrate 20.

The barrier ribs 13 include first barrier rib members 13*a* extending in a first direction (y-direction of the figures) and second barrier rib members 13*b* extending in a second direction (x-direction of the figures). The barrier ribs 13 are formed in a lattice pattern and independently define the discharge cells 14R, 14G, 14B, the discharge cells 14R, 14G, 14B being filled with a discharge gas. R, G, B (red, green, blue) phosphor layers 15R, 15G, 15B are formed on four sides of the barrier ribs 13 and on the floor (−z end) of the discharge cells 14R, 14G, 14B.

On the first substrate 10, address electrodes 11 are formed in a stripe pattern and extend in the first direction. Each address electrode 11 corresponds to one of 14R, 14G, 14B discharge cells. Each address electrode 11 is spaced apart from each other. A dielectric layer 12 covers the address electrodes 11 on the inside side (+z side) of the first substrate 10.

On the inside side (−z side) of the second substrate 20 facing the first substrate 10 are formed display electrodes 24 that consist of a first display electrodes 21 (or a scan electrode) and a second display electrodes 22 (or sustain electrode), both extending in the second direction. A dielectric layer 25 and an MgO protective layer 26 cover the display electrodes 24 on the inside side of the second substrate 20.

The first display electrodes 21 and the second display electrodes 22 are located corresponding to the discharge cells 14R, 14G, 14B and are positioned near the second and first display electrodes 22, 21 respectively of neighboring discharge cells 14R, 14G, 14B in the first direction. Therefore, the first display electrodes 21 and the second display electrodes 22 are paired with each other and located alternately.

The first display electrodes 21 and the second display electrodes 22 includes first and second transparent electrodes 21*a*, 22*a* respectively and facing each other and spaced apart by a discharge gap and extending toward the center of the discharge cells 14R, 14G, 14B. First display electrodes 21 and second display electrodes 22 also include first and second main bus electrodes 21*b*, 22*b* respectively, where each main bus electrode extends in the second direction and has a stripe pattern and is positioned corresponding to each side of the discharge cells 14R, 14G, 14B. The first display electrodes 21 and the second display electrodes 22 further includes first and second auxiliary bus electrodes 21*c*, 22*c* respectively. Each the first auxiliary bus electrodes 21*c* extend in the first direction and connects the first main bus electrode 21*b* of a discharge cell 14R, 14G, 14B to the second main bus electrode 22*b* of a neighboring discharge cell. The first auxiliary bus electrodes 21*c* have a stripe pattern. The second auxiliary bus electrodes 22*c* also extend in the first direction and connect the second main bus electrode 22*b* of the discharge cells 14R, 14G, 14B to the first main bus electrode 21*b* of the other neighboring discharge cell. The second auxiliary bus electrodes 22*c* have a stripe pattern.

The first and the second transparent electrodes 21*a*, 22*a* are preferably made of indium tin oxide (ITO). The first and the second main bus electrodes 21*b*, 22*b* and the first and the second auxiliary bus electrodes 21*c*, 22*c* are preferably made of a highly conductive opaque metal.

The first and the second main bus electrodes 21*b*, 22*b* and the first and the second auxiliary bus electrodes 21*c*, 22*c* are located in the discharge cells 14R, 14G, 14B and absorb outside light so that a bright room contrast of the PDP can be improved by suppressing the reflection of light incident onto the discharge cells 14R, 14G, 14B.

Even when the first and the second auxiliary bus electrodes 21*c*, 22*c* are formed to have a small width in order to achieve a high luminance characteristics, the first and the second auxiliary bus electrodes 21*c*, 22*c* rarely break during the etching process used to make the first and the second main bus electrodes 21*b*, 22*b* and the first and the second auxiliary bus electrodes 21*c*, 22*c* from a metallic material. This is because the first and the second auxiliary bus electrodes 21*c*, 22*c* are in direct connection with both of the first and the second main bus electrodes 21*b*, 22*b*.

Figure 2:
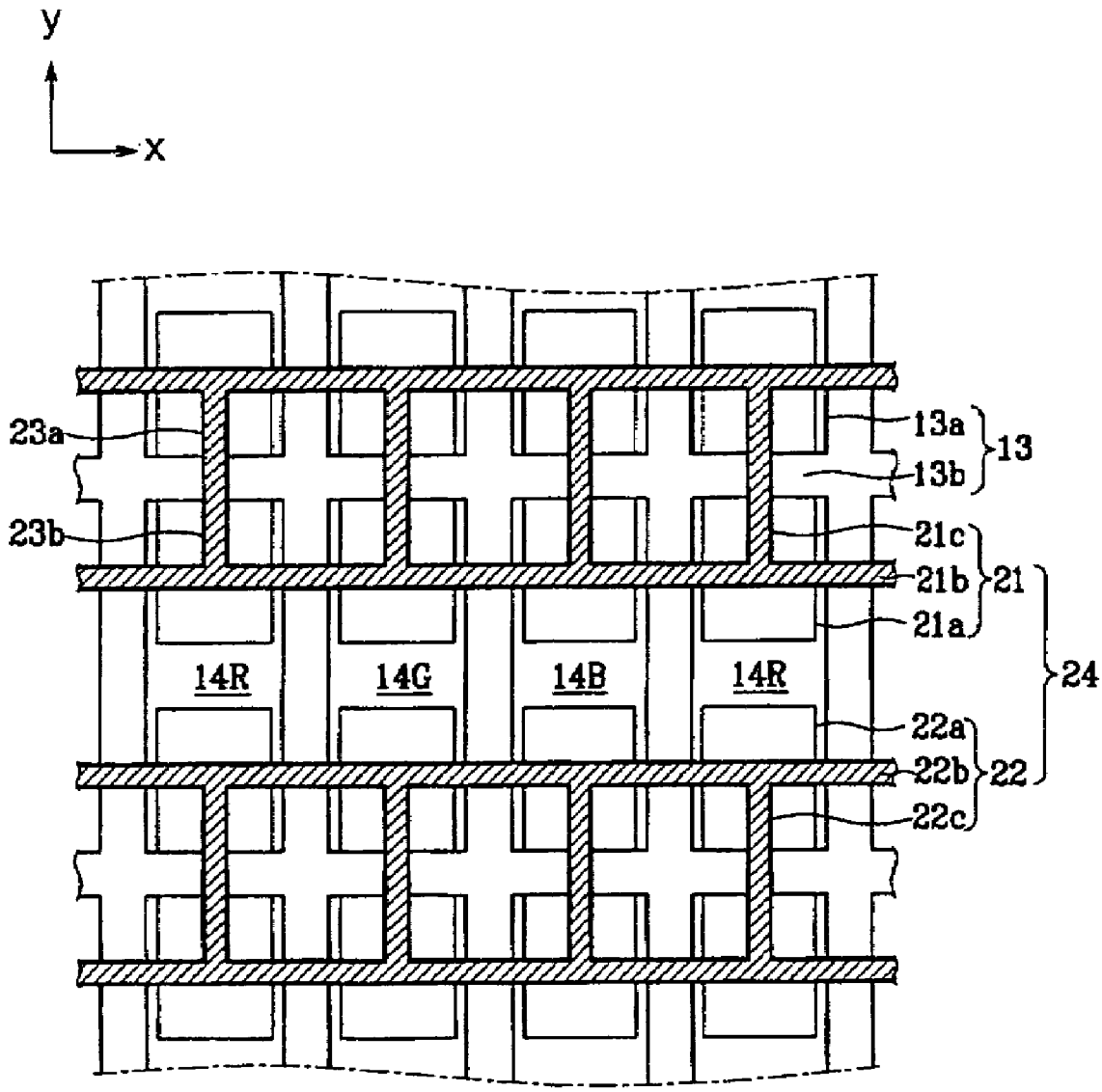
FIG. 2 is a partial plan view illustrating electrodes positioned on the second substrate of the PDP of FIG. 1 according to the first embodiment of the present invention.
Figure 3:
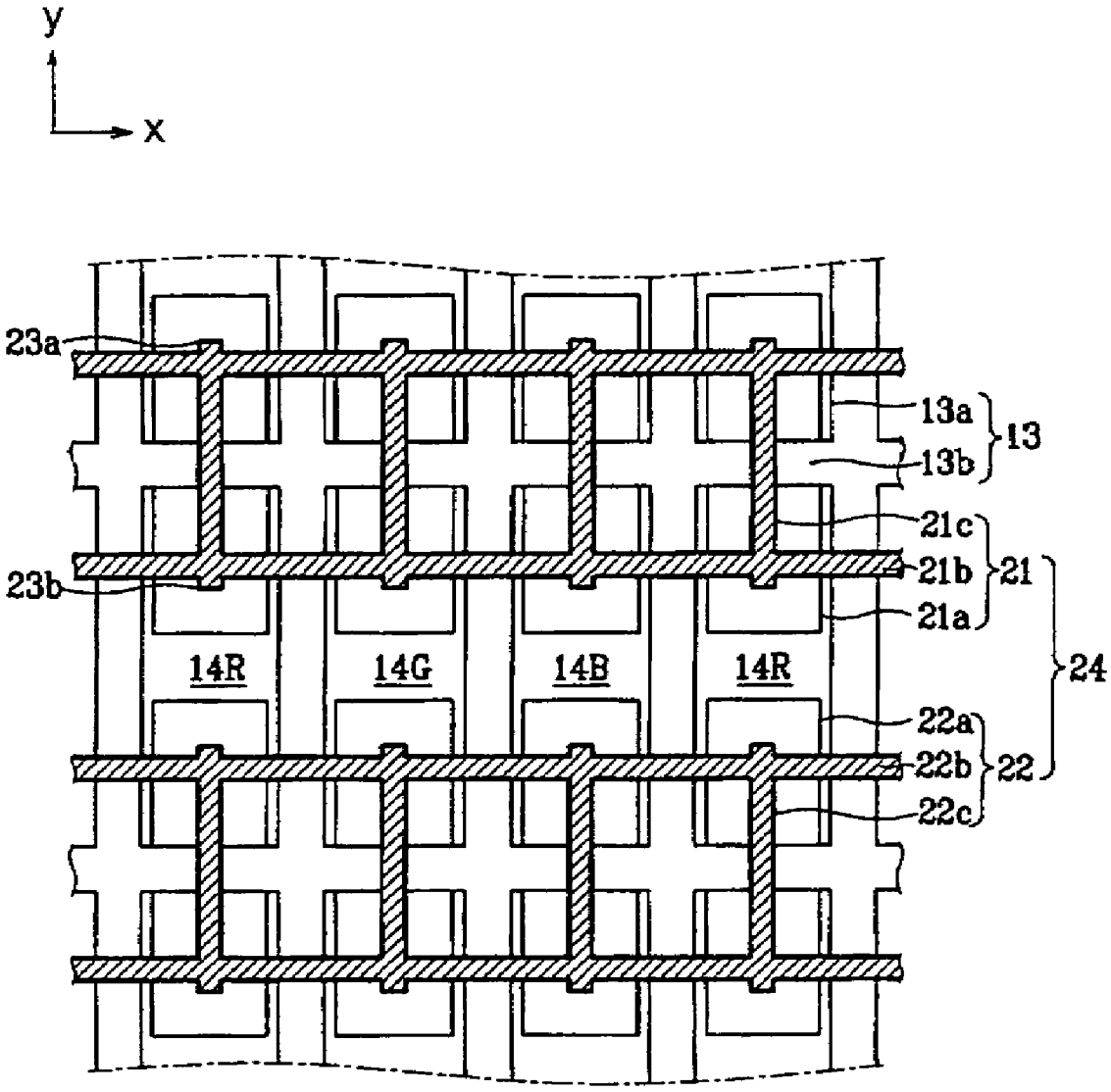
FIG. 3 is a partial plan view illustrating electrodes positioned on the second substrate of a PDP according to a second embodiment of the present invention that can be used in the PDP design of FIG. 1.
Figure 4:
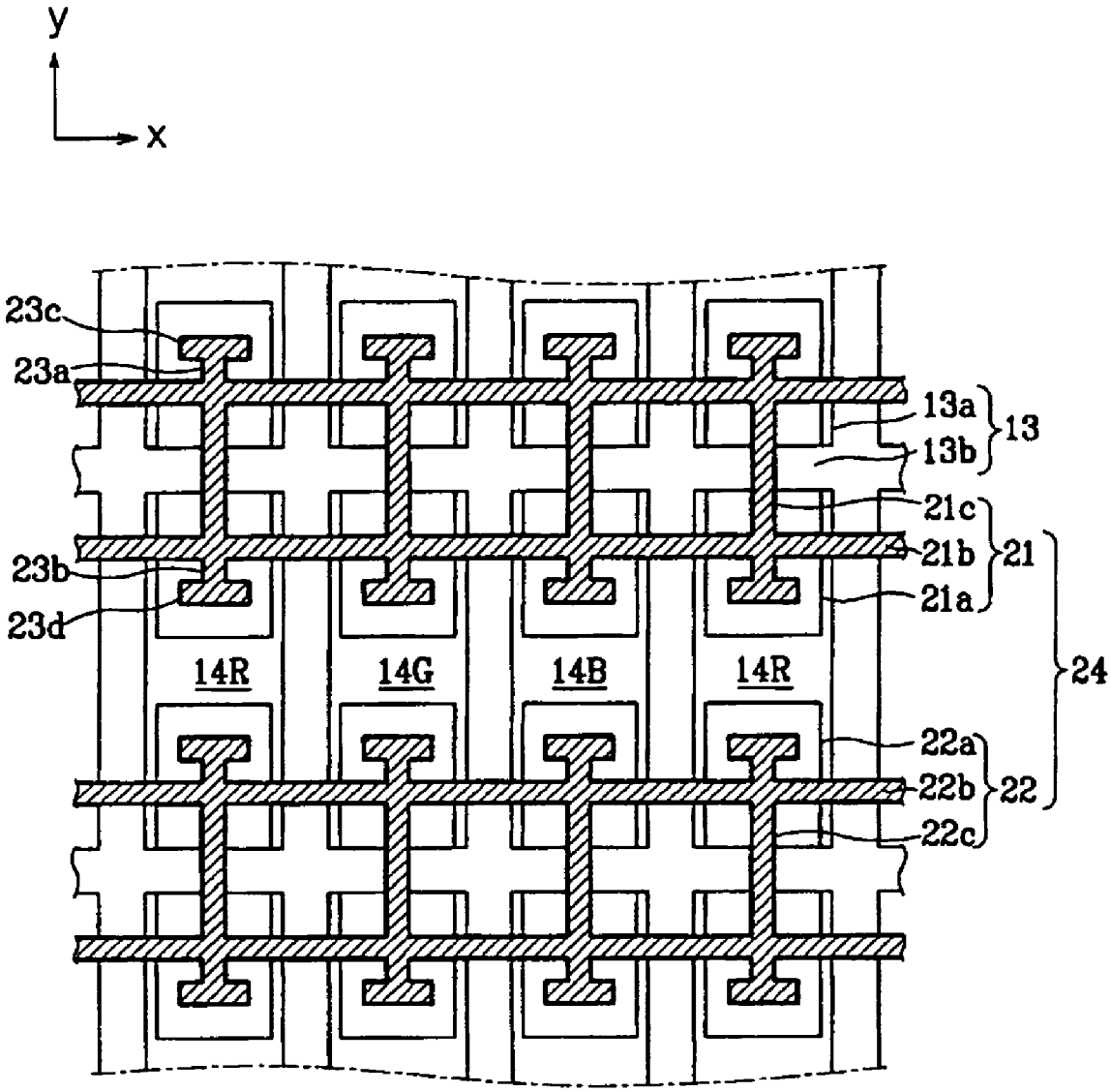
FIG. 4 is a partial plan view illustrating electrodes positioned on the second substrate of a PDP according to a third embodiment of the present invention that can be used in the PDP design of FIG. 1.

In the first embodiment of the present invention as illustrated in FIG. 2, the first auxiliary bus electrodes 21*c* are connected to the first main bus electrodes 21*b* at ends 23*a*, 23*b* thereof. Similarly for the first embodiment of the present invention, the second auxiliary bus electrodes 22*c* are connected to the second main bus electrodes 22*b* at ends 23*a*', 23*b*' thereof. In the second embodiment of the present invention as illustrated in FIG. 3, both ends 23*a*, 23*b* of the first auxiliary bus electrodes 21*c* can extend past the first main bus electrodes 21*b* by a small amount so that they extend towards centers of the discharge cells 14R, 14G, 14B, respectively. Similarly for the second embodiment of the present invention, both ends 23*a*', 23*b*' of the second auxiliary bus electrodes 22*c* can extend past the second main bus electrodes 22*b* by a small amount so that they extend towards centers of the discharge cells 14R, 14G, 14B, respectively. In the third embodiment of the present invention as illustrated in FIG. 4, in addition to that of the second embodiment, the first auxiliary bus electrodes 21*c* each further include protrusions 23*c*, 23*d* at ends 23*a*, 23*b* respectively. Protrusions 23$c$, 23$d$ extend in the second direction from ends 23$a$, 23$b$ respectively. Likewise, in the third embodiment of the present invention, the second auxiliary bus electrodes 22$c$ each further include protrusions 23$c'$, 23$d'$ at ends 23$a'$, 23$b'$ respectively. Protrusions 23$c'$, 23$d'$ also extend in the second direction from ends 23$a'$, 23$b'$ respectively. The designs for the display electrodes 21, 22 illustrated in FIGS. 3 and 4 can be incorporated into the PDP design of FIG. 1 to achieve superior bright room contrast characteristics, superior opening ratio characteristics, superior luminance and easy manufacturing according to the second and third embodiments of the present invention respectively.

As explained above, the PDPs according to the embodiments of the present invention can improve bright room contrast by suppressing the reflection of incident light off the discharge cells 14R, 14G, 14B because outside light is absorbed by the first and the second main bus electrodes 21$b$, 22$b$ and by the first and the second auxiliary bus electrodes 21$c$, 22$c$ located in the discharge cells 14R, 14G, 14B. Also, the PDPs of the present invention can be efficiently manufactured despite the fact that the auxiliary bus electrodes 21$c$, 22$c$ are formed to have a small width. The auxiliary bus electrodes 21$c$, 22$c$ are in direct connection with the main bus electrodes 21$b$, 22$b$ and thus rarely break during the etching process used to make the main bus electrodes 21$b$, 22$b$ and the auxiliary bus electrodes 21$c$, 22$c$ from a metallic material.

Although exemplary embodiments of the present invention have been described in detail hereinabove, it should be understood that many variations and/or modifications of the basic inventive concept taught therein will still fall within the spirit and scope of the present invention, as defined in the appended claims.

What is claimed is:

1. A plasma display panel (PDP), comprising:

a first substrate;

a second substrate arranged facing the first substrate with a space therebetween;

a plurality of address electrodes extending in a first direction and arranged on the first substrate;

a plurality of barrier ribs arranged between the first substrate and the second substrate and dividing the space between the first substrate and the second substrate into a plurality of discharge cells, the plurality of barrier ribs including a plurality of first barrier ribs extending in a first direction parallel to the address electrodes and a plurality of second barrier ribs extending in a second direction orthogonal to the first direction, the plurality of first barrier ribs intersecting ones of the plurality of second barrier ribs;

a phosphor layer arranged inside the discharge cells; and a plurality of display electrodes arranged on the second substrate at locations that correspond to the discharge cells, the display electrodes includes first display electrodes and second display electrodes, wherein each first and second display electrode comprises a first main bus electrode and a second main bus electrode, respectively, with each main bus electrode extending in a second direction and crossing the address electrodes at a location corresponding to sides of the discharge cells, each main bus electrode extending across ones of said plurality of discharge cells, each first and second display electrode further comprises a first auxiliary bus electrode and a second auxiliary bus electrode, respectively, each first auxiliary bus electrode and each second auxiliary bus electrode extending from one of said discharge cells into another of said discharge cells, each first auxiliary bus electrode extending in the first direction and connecting a first main bus electrode of a discharge cell to a second main bus electrode of a neighboring discharge cell, each second auxiliary bus electrode extending in the first direction and connecting a second main bus electrode of the discharge cell to a first main bus electrode of another neighboring discharge cell.

2. The PDP of claim 1, wherein each first display electrode and each second display electrode further comprises a first and a second transparent electrode, respectively, the first and the second transparent electrodes being arranged partially on the first and on the second main bus electrodes, respectively and each extending toward a center of the discharge cell and being arranged to face each other.

3. The PDP of claim 1, wherein each first and each second main bus electrodes and each first and each second auxiliary bus electrode comprises an opaque metallic material adapted to suppress reflection of incident light off the discharge cells.

4. The PDP of claim 1, wherein each first and each second main bus electrodes and each first and each second auxiliary bus electrodes are arranged in a stripe pattern.

5. The PDP of claim 1, wherein each first and each second display electrodes is arranged, respectively, at a location near the second and the first display electrodes of an adjacent discharge cell in the first direction.

6. The PDP of claim 1, wherein each first and each second main bus electrode is arranged near edges of a discharge cell.

7. The PDP of claim 1, wherein each first and each second auxiliary bus electrode is arranged near a center of the discharge cell.

8. The PDP of claim 1, wherein the first auxiliary bus electrodes extend over the first main bus electrodes by a small amount, extending towards centers of corresponding discharge cells, and the second auxiliary bus electrodes extend over the second main bus electrodes by a small amount, extending towards centers of corresponding discharge cells.

9. The PDP of claim 1, wherein the first auxiliary bus electrodes extend over the first main bus electrodes by a small amount, extending towards centers of corresponding discharge cells, the first auxiliary bus electrodes further comprise protrusions attached to ends of the first auxiliary bus electrodes, the protrusions extending in the second direction, the second auxiliary bus electrodes extend over the second main bus electrodes by a small amount, extending towards centers of corresponding discharge cells, and the second auxiliary bus electrodes further comprise protrusions attached to ends of the second auxiliary bus electrodes, the protrusions extending in the second direction.

10. The PDP of claim 1, each of the first and the second display electrodes has a shape of a ladder where the first and the second auxiliary bus electrodes are the rungs of the ladder.

11. The PDP of claim 1, each of the main bus electrodes extend through ones of said plurality of discharge cells.

12. A plasma display panel (PDP), comprising:

a first substrate;

a second substrate arranged facing the first substrate with a space therebetween;

a plurality of address electrodes extending in a first direction and arranged on the first substrate;

a plurality of barrier ribs arranged between the first substrate and the second substrate and dividing the space between the first substrate and the second substrate into a plurality of discharge cells, the plurality of barrier ribs including a plurality of first barrier ribs extending in a first direction parallel to the address electrodes and a plurality of second barrier ribs extending in a second direction orthogonal to the first direction, the plurality of first barrier ribs intersecting ones of the plurality of second barrier ribs;

a phosphor layer arranged inside the discharge cells; and a plurality of display electrodes arranged on the second substrate, the display electrodes include first display electrodes and second display electrodes, wherein each first and second display electrode comprises a first main bus electrode and a second main bus electrode, respectively, with each main bus electrode extending in a second direction and crossing the address electrodes, each main bus electrode extending across ones of said plurality of discharge cells, each first and second display electrode further comprises a first auxiliary bus electrode and a second auxiliary bus electrode, respectively, each first auxiliary bus electrode and each second auxiliary bus electrode extending from one of said discharge cells into another of said discharge cells, each first auxiliary bus electrode extending in the first direction and connecting a first main bus electrode of a discharge cell to a second main bus electrode of a neighboring discharge cell, each second auxiliary bus electrode extending in the first direction and connecting a second main bus electrode of the discharge cell to a first main bus electrode of another neighboring discharge cell, each main bus electrode and each auxiliary bus electrode being arranged to prevent a reflection of external light off the PDP.

13. The PDP of claim 12, each of the first and the second display electrodes has a shape of a ladder where the first and the second auxiliary bus electrodes are the rungs of the ladder.

14. The PDP of claim 12, each of the main bus electrodes extend through ones of said plurality of discharge cells.

15. A plasma display panel (PDP), comprising:

a first substrate;

a second substrate arranged facing the first substrate with a space therebetween;

a plurality of address electrodes extending in a first direction and arranged on the first substrate;

a plurality of barrier ribs arranged between the first substrate and the second substrate and dividing the space between the first substrate and the second substrate into a plurality of discharge cells, the plurality of barrier ribs including a plurality of first barrier ribs extending in a first direction parallel to the address electrodes and a plurality of second barrier ribs extending in a second direction orthogonal to the first direction, the plurality of first barrier ribs intersecting ones of the plurality of second barrier ribs;

a phosphor layer arranged inside the discharge cells; and a plurality of display electrodes arranged on the second substrate, each of said display electrodes having a ladder shape, each display electrode includes a first main bus electrode and a second main bus electrode joined together by a plurality of auxiliary bus electrodes, the first and the second main bus electrodes being sidepieces of the ladder and the auxiliary bus electrodes being rungs of the ladder, each of said display electrodes being arranged to prevent the reflection of external light off the PDP.

16. The PDP of claim 15, each of the main bus electrodes extend across ones of said plurality of discharge cells.

17. The PDP of claim 15, each of the auxiliary electrodes extending across the main bus electrodes.

* * * * *